US009695656B2

(12) United States Patent
Webster et al.

(10) Patent No.: US 9,695,656 B2
(45) Date of Patent: Jul. 4, 2017

(54) SHIFTING TOOL

(71) Applicant: Petrowell Limited, Aberdeen (GB)

(72) Inventors: Oliver Webster, Aberdeenshire (GB); Damien Gerard Patton, Aberdeenshire (GB); Matthew Manning, Aberdeen (GB); Ian Jaffrey, Aberdeenshire (GB)

(73) Assignee: Petrowell Limited, Aberdeen (GB)

( * ) Notice: Subject to any disclaimer, the term of this patent is extended or adjusted under 35 U.S.C. 154(b) by 0 days.

(21) Appl. No.: 14/776,769

(22) PCT Filed: Mar. 14, 2014

(86) PCT No.: PCT/GB2014/050787

§ 371 (c)(1),
(2) Date: Sep. 15, 2015

(87) PCT Pub. No.: WO2014/140609

PCT Pub. Date: Sep. 18, 2014

(65) Prior Publication Data

US 2016/0032670 A1 Feb. 4, 2016

(30) Foreign Application Priority Data

Mar. 15, 2013 (GB) ..... 1304769.1

(51) Int. Cl.
*E21B 23/00* (2006.01)
*E21B 23/02* (2006.01)
(Continued)

(52) U.S. Cl.
CPC ..... *E21B 23/00* (2013.01); *E21B 23/004* (2013.01); *E21B 23/02* (2013.01); *E21B 23/04* (2013.01);
(Continued)

(58) Field of Classification Search
CPC .. E21B 2034/007; E21B 23/00; E21B 23/004; E21B 23/02; E21B 23/04; E21B 34/14
See application file for complete search history.

(56) References Cited

U.S. PATENT DOCUMENTS 3,115,188 A * 12/1963 Cochran ..... E21B 34/14 166/332.4
3,948,322 A * 4/1976 Baker ..... E21B 33/127 166/154
(Continued)

FOREIGN PATENT DOCUMENTS

EP 1367217 A2 12/2003
GB 2392937 A 3/2004
(Continued)

OTHER PUBLICATIONS

Int'l Search Report and Written Opinion in counterpart PCT Appl. PCT/GB2014/050787, dated Dec. 4, 2014.

*Primary Examiner* — James G Sayre
(74) *Attorney, Agent, or Firm* — Blank Rome, LLP

(57) ABSTRACT

A downhole shifting tool (100) for shifting a downhole component (46) comprises a body with a positioning arrangement (108) provided on the body for engaging or interacting with a downhole component to provide alignment of the shifting tool with said component. The tool further includes a connecting member (110) provided on the body and being moveable to selectively engage a connection profile of the downhole component.

51 Claims, 4 Drawing Sheets

(51) Int. Cl.
*E21B 23/04* (2006.01)
*E21B 34/14* (2006.01)
*E21B 34/00* (2006.01)

(52) U.S. Cl.
CPC ..... *E21B 34/14* (2013.01); *E21B 2034/007* (2013.01)

(56) References Cited

U.S. PATENT DOCUMENTS 4,312,406 A * 1/1982 McLaurin ..... E21B 23/04 166/212
4,510,995 A 4/1985 Krause
4,574,894 A * 3/1986 Jadwin ..... E21B 21/103 137/118.03
5,156,220 A * 10/1992 Forehand ..... E21B 33/1208 166/332.7
5,183,114 A * 2/1993 Mashaw, Jr. ..... E21B 34/14 166/319
5,244,044 A * 9/1993 Henderson ..... E21B 23/04 166/238
5,305,833 A * 4/1994 Collins ..... E21B 34/14 166/386
6,223,824 B1 * 5/2001 Moyes ..... E21B 23/00 166/319
8,505,639 B2 * 8/2013 Robison ..... E21B 23/04 166/194
2002/0166667 A1 11/2002 Patel et al.
2005/0072577 A1 4/2005 Freeman
2009/0139726 A1 * 6/2009 Gomez ..... E21B 34/14 166/373
2011/0226489 A1 9/2011 Hofman et al.
2012/0125627 A1 5/2012 George et al.
2014/0158361 A1 * 6/2014 Cheng ..... E21B 23/006 166/308.1
2015/0159469 A1 * 6/2015 Purkis ..... E21B 23/04 166/373
2015/0167429 A1 * 6/2015 Purkis ..... E21B 23/04 166/373

FOREIGN PATENT DOCUMENTS

WO 2011/117601 A2 9/2011
WO 2011/117602 A2 9/2011

* cited by examiner

SHIFTING TOOL

FIELD OF INVENTION

The present invention relates to a shifting tool for use in shifting one or more downhole components.

BACKGROUND TO INVENTION

In the oil and gas industry many wellbore operations rely on the ability to move or shift certain downhole components. Such shifting may be achieved by use of shifting tools, which are typically deployed and manipulated from surface.

For example, components, such as sleeves, may require to be shifted for a variety of reasons, such as to actuate slips, set packers, open one or more ports, or the like.

Also, in some circumstances it may be necessary to shift a downhole component from an active to a redundant position, or vice versa. For example, a ball seat may be initially installed in a configuration in which a ball travelling downhole may be caught, for example to initiate an actuation event, to move the ball seat, to create a plug or flow diversion, or the like. In some cases an operator may decide that the function of the ball seat is no longer required, and thus may take positive steps to move the ball seat to a position where the seat no longer functions.

WO 2011/117601 and WO 2011/117602 each disclose a mechanical counting device which is mounted within a housing and is configured to be acted upon by a number of passing balls dropped from surface to linearly progress the device along the housing in a corresponding number of discrete steps until reaching an actuation site, whereupon an associated tool is actuated. UK patent application 1223191.6 also discloses a mechanical counting device, or indexing sleeve, which is acted upon by a number of passing balls to move in corresponding discrete steps. UK 1223191.6 discloses the ability to move the indexing sleeve with a shifting tool to a redundant position such that passing balls to not cause any movement thereof, thus preventing an associated tool from being actuated.

SUMMARY OF INVENTION

An aspect of the present invention relates to an apparatus, such as a shifting tool, for use in shifting a component, such as a downhole component. The apparatus or tool may comprise a connecting member to permit connection with a component. The apparatus may comprise a positioning arrangement to facilitate alignment of the apparatus with a component.

An aspect of the present invention relates to a downhole shifting tool for shifting a downhole component, comprising:

a body;

a positioning arrangement provided on the body and configured to engage or interact with a downhole component to provide alignment of the shifting tool with said component; and a connecting member provided on the body and being moveable to selectively engage a connection profile of the downhole component.

An aspect of the invention relates to the use of the shifting tool, for example in a method for controlling a downhole component.

An aspect of the invention relates to a downhole system comprising a shifting tool and a downhole component to be shifted by the shifting tool.

In use, the shifting tool may be deployed towards a component to be shifted. The positioning arrangement may interact with the downhole component, thus providing appropriate alignment of the shifting tool with the component. The connecting member may be moved to engage the connection profile on the component, thus providing a connection between the shifting tool and the component. Once such a connection is achieved, the shifting tool may be appropriately moved to shift the component as desired.

The shifting tool may be configured to operate the downhole component. For example, the shifting tool may provide a primary actuation to operate the downhole component.

The shifting tool may be configured to activate the downhole component, for example for subsequent actuation by the shifting tool and/or an alternative actuation arrangement, such as an actuation object deployed from surface, for example a ball, dart, plug or the like.

The shifting tool may be configured to deactivate the downhole component, for example such that further or subsequent actuation, for example by a separate actuation arrangement is prevented. For example, the downhole component may be originally configured for actuation by an actuation arrangement, such as an actuation object deployed from surface, for example a ball, dart or the like. The shifting tool may reconfigure the downhole component to a deactivated state, in which such an actuation object may pass the component without also actuating said component. Such an arrangement may provide a significant degree of flexibility for an operator, for example permitting an operator to selectively deactivate a downhole component in accordance with changing requirements and the like.

The provision of a physical interaction between the positioning arrangement and the downhole component may provide a positive feedback, for example to an operator, which confirms that the shifting tool has reached the desired location. Such a positive indication may facilitate or initiate actuation of the connecting member, for example by manual intervention or operation by an operator, by an autonomous or automatic sequence, or the like.

The downhole component to be shifted may be mounted within a housing. In such an arrangement the shifting tool may be configured to shift the component within, for example axially along, the housing. The component and the housing may form part of a downhole system.

The downhole component may comprise a valve member configured to vary a downhole flow path, for example to open, close and/or regulate a downhole flow path. In such an arrangement the shifting tool may be configured or operable to manipulate the valve member to permit the flow path to be varied. The shifting tool may be operable to configure the valve member in a desired state, for example into a state in which subsequent actuation is prevented, or permitted. As such, the shifting tool may be configured to one or both activate and deactivate the valve member.

The downhole component may comprise a downhole restriction. Such a restriction may be provided, for example, for catching an object, such as a ball, dart or the like. Such a downhole restriction may be defined by a seat configured to be engaged by an object. Such a restriction may be provided to provide a desired back pressure or pressure profile within the associated downhole environment. The shifting tool may be configured or operable to manipulate the downhole component to vary the downhole restriction, for example to establish the restriction, remove the restriction, vary the restriction or the like.

The downhole component may comprise a downhole actuator, configured to actuate a further downhole tool or system. For example, the component may be provided within a downhole system and configured to be moved and actuate a further downhole tool or system, such as a downhole valve, fracturing tool, packer, bridge plug, slips or the like. The shifting tool may be configured or operable to move the downhole component to permit said component to actuate a further downhole tool or system. The shifting tool may be configured or operable to deactivate the downhole component such that subsequent use of the downhole component to actuate a further downhole tool or system is prevented.

The downhole component may comprise a sleeve or sleeve assembly. The downhole component may comprise a collet sleeve assembly. In such an arrangement the positioning arrangement of the shifting tool may be configured to interact with one or more collet members provided on the downhole component.

The downhole component may comprise an indexing arrangement, configured to be operated to move in a number of discrete movement steps, for example upon passage of a corresponding number of actuation objects. Such an indexing arrangement may be operated to move in a desired number of discrete movement steps towards an actuation site, wherein upon reaching the actuation site a downhole tool or system may be actuated. The shifting tool may be operable to deactivate the indexing arrangement such that further movement thereof is prevented, for example such that any passing actuation objects will not function to move the indexing arrangement a corresponding discrete movement step. This may prevent the indexing arrangement from reaching the actuation site.

The shifting tool may be configured to be at least partially deployed into the component, for example into a central bore defined by the component. In such an arrangement the positioning arrangement may be configured to interact with an inner surface region or structure of the component. Further, the connecting member may be configured to engage a connection profile formed on an inner surface of the component.

The shifting tool may be configured or operable to rotate the downhole component. The connecting member may be configured to transmit torque between the shifting tool and the component.

The shifting tool may be configured or operable to axially shift the downhole component. The shifting tool may be configured to axially shift the downhole component in one or both of an uphole and a downhole direction. In this respect it should be understood that the downhole direction is that direction away from an entry point of an associated wellbore, and the uphole direction is in an opposite direction, towards an entry point of an associated wellbore.

In some embodiments the shifting tool may be configured to both rotate and axially shift the downhole component. In some embodiments the downhole component may be configured to be rotated upon application of an axial shifting force, and/or be configured to be axially shifted upon application of a rotational shifting force. Such an arrangement may be achieved via a J-slot mechanism, or equivalent structure, for example.

The shifting tool may be configured to approach the downhole component in a deployment direction, and subsequently shift the downhole component in a shifting direction. Thus, in use, the shifting tool may approach the downhole component such that the positioning arrangement interacts with the downhole component in a deployment direction. The connecting member may be engaged with the connecting profile of the component, and the apparatus then manipulated to move the component in a shifting direction.

The deployment direction may comprise an axial direction.

The shifting direction may comprise an axial direction.

In one embodiment the deployment direction and the shifting direction may be provided in a common direction. As such, the shifting tool may be moved in one direction to engage the downhole component, and once a connection is made via the connecting member, the shifting tool may continue in the same direction to shift the downhole component in this same direction.

In one embodiment the deployment direction and the shifting direction may be opposite each other. For example, the apparatus may be deployed towards and engage the downhole component in one direction, and then shift the component in an opposite direction.

In one embodiment the deployment direction may be in a downhole direction. That is, the apparatus may approach the downhole component while being deployed in a downhole direction.

In one embodiment the shifting direction may be in an uphole direction. That is, the apparatus may be operated to shift the downhole component in an uphole direction.

The shifting tool may be configured to initially prevent the downhole component from movement upon initial engagement of the positioning arrangement with the component. Such initial locking of the component may be provided at least until the connecting member makes or establishes an appropriate connection with the connection profile on the component.

The positioning arrangement may be configured to engage the downhole component in a deployment direction and prevent the downhole component from movement in the deployment direction. For example, the shifting tool may lock the downhole component against movement in the deployment direction when initially engaged therewith. Such an arrangement may minimise the risk of the shifting tool shifting the downhole component in a undesired direction. Further, such an arrangement may provide a positive feedback that appropriate engagement of the shifting tool with the downhole component has been achieved. That is, once the positioning arrangement has engaged the downhole component, further deployment of the shifting tool may not be permitted, providing feedback that a desired relative positioning of the apparatus with the component has been achieved.

The shifting tool may be configured such that the positioning arrangement initially engages or interacts with the downhole component in a deployment direction while the connecting member is misaligned with the connection profile on the component. Such an arrangement may be achieved by an axial spacing between the positioning arrangement and the connecting member. Such misalignment may be provided in the deployment direction, such that the connecting member may have travelled past the connection profile on the downhole component. In such an arrangement the shifting tool may be configured to provide a degree of initial overshoot of the connecting member relative to the connection profile of the downhole component. In such an initial engaged position the positioning arrangement may function to lock the component against movement, which may provide a positive feedback that the shifting tool has appropriately reached and engaged the downhole component. The shifting tool may be arranged to be subsequently moved in an opposite direction, which may be a shifting direction, to align and permit engagement of the connecting member with the connection profile. When such alignment is achieved the positioning arrangement may be disengaged from the downhole component, and positioned such that the downhole component is no longer locked, and is free to be shifted by the shifting tool, at least in the shifting direction.

In one embodiment the connecting member may be moved towards a connected position prior to alignment with the connection profile of the downhole component, such that upon achieving alignment a suitable connection may be achieved. In such a case, initially moving the shifting tool in a shifting direction may eventually cause connection between the connecting member and connection profile.

The positioning arrangement may define a positioning profile configured to interact with the downhole component. The positioning profile may be formed on an outer surface of the body of the apparatus. The positioning profile may be fixed, for example to define a permanent feature of the shifting tool. Alternatively, the positioning profile may be variable, for example to permit adjustment. Such adjustment may permit the shifting tool to be utilised in combination with different components, for example.

The positioning profile may be configured or formed to facilitate engagement with the downhole component in an axial direction. Such an axial direction may be a deployment direction of the shifting tool. As such, the positioning profile may permit axial engagement with the downhole component during deployment of the shifting tool. In such an arrangement, the positioning profile may facilitate force transfer between the shifting tool and the downhole component in an axial direction. Such force transmission may provide a degree of feedback that the shifting tool has been appropriately aligned with the downhole component.

The positioning profile may be configured to facilitate engagement with the downhole component in a radial direction. In such an arrangement, the positioning profile may facilitate force transfer between the shifting tool and the downhole component in a radial direction. Such radial engagement may permit the shifting tool to lock the component against movement. For example, movement of the component in at least one direction may be dependent on the ability of a feature of the component from being freely radially displaceable. However, forming the positioning profile to radially support such a feature of the component, when aligned therewith, may thus prevent radial displacement, and thus facilitate locking of the component.

The component to be shifted may define an interface arrangement, wherein the positioning arrangement, for example a positioning profile, may be configured to engage or interact with said interface arrangement. The interface arrangement of the downhole component may be separate from the connection profile. As such, the positioning arrangement and the connecting member of the shifting tool may be arranged to engage separate features or regions of the downhole component.

The interface arrangement and connection profile of the downhole component may be separated by a first axial distance, and the connecting member and positioning arrangement may be separated by a second axial distance. The first and second distances may be substantially the same. In such an arrangement alignment between the positioning arrangement and interface arrangement, and between the connecting member and connection profile may be achieved substantially simultaneously. Alternatively, the first and second distances may be different. In such an arrangement alignment between the positioning arrangement and interface arrangement, and between the connecting member and connection profile may not be achieved simultaneously. Such an arrangement may permit a degree of overshoot, for example, of the connecting member relative to the connection profile, for example in a deployment direction of the shifting tool.

The positioning arrangement may be configured to facilitate engagement with the interface arrangement in an axial direction. The positioning arrangement may be configured to facilitate engagement with the interface arrangement in a radial direction.

The interface arrangement of the component to be shifted may be provided exclusively for interfacing or engaging with the positioning arrangement of the shifting tool.

In some embodiments, the interface arrangement of the component may define an operational arrangement of the component, configured to permit operation of the component prior to or following any engagement or shifting by the shifting tool. For example, the interface arrangement may be configured to be engaged by an actuation object for use in operating the component prior to or following any engagement or shifting by the shifting tool. Suitable actuation objects may include balls, darts, plugs, any other object dropped or otherwise passed into a wellbore to perform an actuation function, or any combination of these.

The interface arrangement of the downhole component may define a seat configured to be engaged by an actuation object prior to or following any engagement or shifting by the shifting tool. Such engagement may permit movement of the component. Such engagement between an actuation object and a seat may establish a fluid barrier.

Prior to or following any engagement or shifting by the shifting tool, the interface arrangement of the component may be configured to be engaged by a passing actuation object such that said passing object may move the component. Such movement may be in a direction towards an actuation site, wherein upon reaching the actuation site the downhole component may actuate a further downhole tool or system or the like. The interface arrangement may permit the component to be driven by a discrete movement step. In such an arrangement, prior to or following any engagement or shifting by the shifting tool the interface arrangement may be configured to be engaged by multiple passing actuation objects to be driven by a corresponding number of discrete movements steps. The interface arrangement may be configured to temporarily capture a passing actuation object to permit the object to drive the component a discrete movement step, and subsequently release the object upon completion of the discrete movement step.

The interface arrangement of the component may be configured to cooperate with an indexing profile on a separate object or structure. The interface arrangement may be configured to cooperate with an indexing profile on a housing within which the component is mounted. The component and the housing may be provided in a common downhole system.

Cooperation and engagement between the positioning arrangement of the shifting tool, the interface arrangement of the component and a separate indexing profile may facilitate appropriate alignment of the shifting tool and the component.

In one embodiment, cooperation and engagement between the positioning arrangement of the shifting tool, the interface arrangement of the component and a separate indexing profile may facilitate appropriate locking of the component, for example against movement in a deployment direction.

In one embodiment, cooperation and engagement between the interface arrangement of the component, an actuation object and an associated indexing profile may permit the indexing component to be driven by a discrete movement step, prior to or following any engagement or shifting by the shifting tool.

The shifting tool may be configured to shift the component to align the interface arrangement with a deactivated region of an associated indexing profile, such as may be provided on a surrounding housing. In such an arrangement, the deactivated region of an associated indexing profile may permit the interface arrangement to adopt a deactivated configuration or position, such that subsequent engagement with an actuation object is prevented.

The interface arrangement may include at least one engagement member. The at least one engagement member may be radially moveable between a radially outward position and a radially inward position. Such radial movement may be achieved by cooperation with a separate indexing profile, such as provided on a surrounding housing. Such an indexing profile may comprise one or more recesses, such as annular recesses formed in a surrounding housing, configured to receive the at least one engagement member when positioned radially outwardly. In such an arrangement, when the at least one engagement member is aligned with a recess, said member may be permitted to be moved radially outwardly. Further, when the at least one engagement member is not aligned with a recess, said member is not permitted to be moved radially outwardly, and as such is retained within a radially inward position.

The positioning arrangement of the shifting tool may be configured to axially engage at least one engagement member when said member is positioned radially inwardly. Such an arrangement may facilitate appropriate alignment between the shifting tool and the component, for example as the shifting tool approaches and engages the component in a deployment direction. Such axial engagement may facilitate a degree of feedback that initial engagement has been achieved.

The positioning arrangement of the shifting tool may be configured to radially support at least one engagement member when said member is positioned radially outwardly. Such an arrangement may facilitate locking of the component, for example against movement in a deployment direction of the shifting tool, at least when the shifting tool initially engages the component. For example, the positioning arrangement may effectively prevent any inward radial movement of said member, which may facilitate locking of the component, for example relative to an associated indexing profile, such as a recess.

The positioning arrangement may comprise a positioning profile which includes an axially facing surface profile. Such an axially facing surface profile may be configured to axially engage at least one engagement member when said member is positioned radially inwardly. Such engagement may define an initial engagement of the shifting tool with the component, for example in a deployment direction. In one embodiment the axially facing surface profile may be provided on an annular lip which is provided or formed on the body of the shifting tool.

The positioning arrangement may comprise a positioning profile which includes a radially facing surface profile. Such a radially facing surface profile may be configured to radially interengage or interact with at least one engagement member when aligned therewith, for example axially aligned therewith, such as upon initial engagement of the shifting tool with the component. For example, the radially facing surface profile may prevent radial inward movement of an engagement member when aligned therewith. In such an arrangement, when the radially facing surface profile is aligned with an engagement member, such as axially aligned, said surface profile may function to lock said engagement member in a radially outward position, for example locked within a recess of an associated indexing profile, such as may be provided on a surrounding housing. In one embodiment the radially facing surface profile may be provided on an lip which is provided or formed on the body of the shifting tool. The radially facing surface profile may be defined by a circumferential surface, such as may be provided on an annular lip.

In some embodiments the positioning arrangement may comprise a positioning profile which includes a relief profile. The relief profile may be defined by a region of reduced outer diameter on the body of the shifting tool. The relief profile may be configured to permit radial movement of at least one engagement member when aligned therewith, for example axially aligned therewith. Such an arrangement may permit an engagement member, when aligned with the relief profile, to move radially, for example during the process of the component being shifted by the shifting tool. In one embodiment the relief profile may be axially spaced from the connecting member such that when the connecting member is engaged with a connection profile on the downhole component, the relief profile is axially aligned with an engagement member.

Radial movement of at least one engagement member may permit the at least one engagement member to be moved radially inwardly and outwardly to be selectively engaged by an actuation object and a separate indexing profile, prior to any engagement or shifting by the shifting tool.

The shifting tool may be configured to shift the component to a position in which the at least one engagement member is positioned radially outwardly to prevent any subsequent engagement with a passing actuation object.

The interface arrangement may comprise first and second engagement members. The first and second engagement members may be axially spaced from each other.

The first and second engagement members may be arranged to be selectively moved radially by cooperation with a separate indexing profile, for example provided on an outer housing, during movement of the component, for example through the housing. Such radial movement of the first and second engagement members may selectively extend and retract said members relative to a central bore of the component. That is, the engagement members may be moved radially outwardly to be radially extended from the central bore, and moved radially inwardly to be radially retracted into the central bore.

The radial position of the first and second engagement members may be cyclically varied by cooperation with a separate indexing profile, for example provided on an outer housing, during movement of the component, for example through the housing.

The radial position of the first and second engagement members may be varied out of phase relative to each other by cooperation with a separate indexing profile, for example provided on an outer housing, during movement of the component, for example through the housing. That is, one of the engagement members may be positioned radially inwardly, while the other engagement member may be positioned radially outwardly, with the position of each member varying in an out of phase manner as the component is moved, for example through the housing.

The positioning arrangement may be configured to initially engage the interface arrangement in a deployment direction, such that one engagement member which is positioned radially inwardly is axially engaged in this deployment direction, and the other engagement member which is positioned radially outwardly (for example received within a recess in a surrounding housing) is prevented from becoming radially retracted. In such an arrangement movement of the component in the deployment direction may be prevented.

The positioning arrangement may comprise a positioning profile which includes an axially facing surface profile and a radially facing surface profile. The axially facing surface profile and the radially facing surface profile may be axially separated along the body. Such an axial separation may be substantially similar to an axial separation between the first and second engagement members. This arrangement may permit the axially facing surface profile to axially engage one of the first and second engagement members when said member is positioned radially inwardly, and the radially facing surface profile to simultaneously be axially aligned with the other of the first and second engagement members when said member is positioned radially outwardly, thus preventing radially inward movement of this engagement member. This arrangement may thus be utilised to effectively lock the downhole component against movement, at least in the deployment direction. This arrangement may also facilitate feedback that alignment between the shifting tool and the component has been achieved.

The positioning profile may include or define a relief profile. In one embodiment the positioning profile may comprise first and second relief profiles. One or both of said first and second relief profiles may be defined by regions of reduced outer diameter on the body of the shifting tool. The first and second relief profiles may be axially separated along the body. Such an axial separation may be substantially similar to an axial separation between the first and second engagement members. This arrangement may permit both relief profiles to be simultaneously axially aligned with a respective engagement member. Such relief profiles may be configured to permit radial movement of the engagement members when axially aligned therewith. Such an arrangement may permit the engagement members, when aligned with the respective relief profiles, to move radially, for example during the process of the component being shifted by the shifting tool. In one embodiment the relief profiles may be axially spaced from the connecting member such that when the connecting member is engaged with a connection profile on the downhole component, the relief profiles are axially aligned with a respective engagement member.

A first relief profile may be positioned on one axial side of both the axially and radially facing surface profiles, and a second relief profile may be positioned axially intermediate the axially and radially facing surface profiles.

The first and second engagement members may be configured to be sequentially engaged by an actuation object passing through the indexing sleeve to drive the component a discrete movement step prior to any engagement or shifting by the shifting tool. Cooperation of the first and second engagement members with a separate indexing profile, such as may be provided on a surrounding housing, may permit said members to be sequentially engaged by a passing actuation object to facilitate movement of the component by a discrete movement step prior to any engagement or shifting by the shifting tool.

The shifting tool may be configured to shift the component to a position, for example relative to a separate indexing profile, which permits both the first and second engagement members to be positioned radially outwardly simultaneously, and thus deactivated from any subsequent interaction with a passing object, for example.

One or both of the first and second engagement members may be mounted within a slot extending through a wall structure of the component. Such an arrangement may permit the engagement member to cooperate with a separate indexing profile, for example on an outer housing, to be moved radially and become selectively extended and retracted relative to a central bore of the component.

One or both of the first and second engagement members may be biased in a preferred radial direction. In one embodiment one or both of the first and second engagement members may be biased in a radially outward direction. In such an arrangement one or both of the first and second engagement members may be biased in a direction to be retracted from a central bore of the component. Such a bias may function to at least temporarily retain the component at a set position, for example in the absence of a sufficient shifting force.

One or both of the first and second engagement members may be mounted on a respective finger provided as part of the engaging arrangement. The finger may define a collet finger. The finger may be deformable to permit appropriate radial movement of the associated engagement member. The finger may be resiliently deformable to provide a desired bias.

The engaging arrangement may comprise an array of first engagement members. The array of first engagement members may be arranged circumferentially. The array of first engagement members may be manipulated collectively, for example simultaneously, by cooperation with a separate indexing profile, for example provided on a surrounding housing.

The engaging arrangement may comprise an array of second engagement members. The array of second engagement members may be arranged circumferentially. The array of second engagement members may be manipulated collectively, for example simultaneously, by cooperation with s separate indexing profile, for example provided on an outer housing.

The component may be advanced along the housing in a discrete movement step by impact of an actuation object against one or both of the first and second engagement members.

The component may be advanced along the housing in a discrete step by a differential pressure applied between upstream and downstream sides of component.

The shifting tool may be configured to shift the component such that the interface arrangement is deactivated, for example such that any subsequent operation of the component via the interface arrangement, for example by an actuation object, is not permitted.

In one embodiment an indexing profile of an associated housing may facilitate the component to become disabled. The indexing profile may comprise a disabled region, wherein alignment of the component with the disabled region of the indexing profile permits the component to become disabled.

The indexing profile, for example of an associated housing, may define a longitudinal variation in the inner diameter of the housing.

The indexing profile of the housing may comprise a plurality of annular recesses arranged longitudinally along the housing.

Each annular recess may define a location of increased inner diameter of the indexing region of the housing. An intermediate surface between adjacent annular recesses may define a location of reduced inner diameter of the indexing region of the housing. Accordingly, the presence of a plurality of annular recesses may provide a variation of the inner diameter along the length of the housing, such that movement of the component through the housing may permit the radial position of at least one engagement member of an interface arrangement to be accordingly varied, and thus permit appropriate engagement by a passing actuation object.

During movement of the component longitudinally through a housing at least one engagement member may be sequentially received within adjacent annular recesses. When received within a recess an engagement member may be positioned radially outwardly and extended from a central bore of the component. When positioned intermediate adjacent recesses an engagement member may be positioned radially inwardly and thus retracted into a central bore of the component and thus presented into a path of travel of an actuation object through the component. Accordingly, a passing actuation object may act on a engagement member in accordance with cooperation of the engagement member with the annular recesses of the housing.

At least one pair of annular recesses may be arranged at a different axial spacing than the first and second engagement members of an interface arrangement of a component. At least one pair of adjacent annular recesses may be arranged at a different axial spacing than the first and second engagement members. Such an arrangement may permit the first and second engagement members to be alternately, for example in an out of phase manner, moved radially outwardly and inwardly during movement of the component through the housing.

The indexing profile may comprise multiple annular recesses arranged longitudinally along the housing at a common axial separation or pitch. Such an arrangement may permit the component to be moved in a number of equal discrete steps of movement. The common axial separation or pitch may differ from the axial separation of the first and second engagement members. In some embodiments a plurality of annular recesses may be longitudinally arranged at a common separation pitch, wherein the axial separation of the first and second engagement members differs from this separation pitch or an integer multiple of this separation pitch.

The indexing profile may comprise at least one pair of annular recesses which are arranged at an axial spacing which is equivalent to the axial spacing of the first and second engagement members. In such an arrangement appropriate positioning of the component within the housing may permit both the first and second engagement members to be simultaneously positioned within a respective recess and thus positioned radially outwardly and extended from the central bore, thus effectively disabling the component. The shifting tool may permit such a positioning of the component to be achieved.

One axial end region of the indexing profile may comprise a pair of annular recesses provided at an axial spacing which is equivalent to the axial spacing of the first and second engagement members. In such an arrangement, upon reaching the axial end region of the indexing profile the component may become disabled. This axial end region may comprise or define an actuation site.

Opposing axial end regions of the indexing profile may comprise a pair of annular recesses with an axial spacing which corresponds to the axial spacing of the first and second engagement members of the interface arrangement of the component. Such an arrangement may permit the component to be disabled upon location at either axial end region of the indexing profile.

The component may be initially positioned, for example during commissioning, at any desired location along the indexing profile. Such an initial position along the indexing profile may determine the required number of actuation objects, and thus required discrete steps of movement, to drive the component to an actuation site and actuate an associated downhole tool.

In one embodiment the positioning arrangement may be positioned on an uphole side of the connecting member. Alternatively, the positioning arrangement may be located on a downhole side of the connecting member.

The positioning arrangement and the connecting member may be located at a common axial location on the body.

The connecting member may be configured to provide a releasable connection with the connection profile of the downhole component.

The connecting member may be radially moveable relative to the body to selectively engage a connection profile of a downhole component.

The shifting tool may comprise an actuation arrangement configured to actuate the connecting member, for example to move radially, to selectively engage the connection profile of the downhole component.

The actuation arrangement may comprise a piston assembly configured to permit actuation of the connecting member. In one embodiment axial stroking of the piston assembly may permit actuation of the connecting member.

The piston assembly may positively move the connecting member in at least one radial direction, that is, at least one of radially outwardly and radially inwardly. In one embodiment the piston assembly may positively move the connecting member both radially outwardly and inwardly. In such an arrangement the piston assembly may provide full control of the connecting member. Further, such an arrangement may permit the piston assembly to control both connection and disconnection of the connecting member with the connection profile of the downhole component.

In one embodiment the piston assembly may positively move the connecting member in only one radial direction, for example in only one of radially outwardly and inwardly.

The connecting member may be biased in a radial direction. Such a bias may permit or provide movement of the connecting member in the direction of bias. The actuation arrangement may comprise a biasing arrangement configured to bias the connecting member in a desired radial direction. The biasing arrangement may comprise one or more spring members.

In one embodiment the piston assembly may be operable to act against a bias force associated with the connecting member. Accordingly, the connecting member may be moved in one radial direction by action of a bias force, and in an opposite radial direction by action of the piston assembly against this bias force. In such an arrangement the piston assembly may be configured to act as a retaining arrangement to hold the connecting member against the action of the biasing force. As such, the piston assembly may be operated to release the connecting member to permit a bias force to then move the connecting member.

In one embodiment the connecting member may be biased radially outwardly, and the piston assembly may be operated to move the connecting member radially inwardly. In such an arrangement the connecting member may be biased in a direction to engage a connection profile of a downhole component. The piston assembly may be configured to retain the connecting member in this radially inward position.

The piston assembly may be configured to engage the connecting member via an actuation interface. This actuation interface may convert axial stroking motion of the piston assembly to radial motion of the connecting assembly. The actuation interface may comprise interengaging ramp surfaces, for example.

The piston assembly may be arranged to engage a single axial side of the connecting member, for example via a single actuation interface. Alternatively, the piston assembly may be configured to engage opposing axial sides of the connecting member, for example via two axially separated actuation interfaces.

The piston assembly may be fluid actuated or operated. The shifting tool may comprise an onboard source of fluid for use in actuating the piston assembly. In such an arrangement the shifting tool may further comprise pressurising apparatus, such as one or more pumps, for use in creating a desired fluid pressure to actuate the piston assembly.

Alternatively, or additionally, the shifting tool may be configured for communicating with an external source of fluid. In such an arrangement the external source of fluid may be delivered to the shifting tool via pressurising equipment. The external source of fluid may be located at surface. The external source of fluid may be located downhole. In one embodiment the source of fluid may comprise ambient fluid within the downhole environment, for example externally of the shifting tool. In such an arrangement a pressure of the ambient fluid, such as a hydrostatic pressure of the ambient fluid, may be of sufficient magnitude to permit operation of the piston assembly without further pressurising equipment. The shifting tool may be configured to be coupled to a conduit, such as coiled tubing, a work string, or the like for communicating with a source of fluid pressure.

In one embodiment the body may define a central bore configured to receive fluid from an external source, and subsequently communicate this fluid to the piston assembly, for example via one of more fluid communication ports. The central bore may be closed such that pressure therein may be elevated, for example by use of pressurising equipment, such as one or more pumps. The central bore may define a flow restriction to permit a backpressure to be created within a fluid flowing through the central bore. This backpressure may be sufficient to operate the piston assembly. The flow restriction may comprise a nozzle, orifice or the like. The flow restriction may be variable. In such an arrangement the flow restriction may permit an actuation fluid pressure to be controlled or varied.

The piston assembly may comprise a piston member configured to stroke axially relative to the body and permit actuation of the connecting member. The piston member may comprise a piston sleeve. The piston member may be fluid actuated.

The piston member may be configured to stroke in opposing axial directions between first and second axial positions. The piston member may be fluid actuated to stroke in at least one direction.

In one embodiment the piston member may be fluid actuated to stroke in opposing directions.

In one embodiment the piston member may be fluid actuated to stroke in a single direction. The piston member may be biased in an opposing direction. Such an arrangement may simplify the required fluid control within the piston assembly. The piston member may be fluid actuated to stroke in a direction to permit the connecting member to be radially extended.

The piston assembly may comprise first and second piston members, for example piston sleeves, mounted on opposing axial sides of the connecting member. In such an arrangement the piston assembly may be configured to act on opposing axial sides of the connecting member.

The connecting member may comprise a no-go profile, configured to provide an axial connection between the shifting tool and a downhole component in at least one direction.

The connecting member may comprise a kick-down profile configured to engage a corresponding downhole kick-down profile. The respective kick-down profiles may be configured to interact in an axial direction to cause the connecting member to disengage the connection profile of the downhole component.

In one embodiment the downhole component may be mounted within a housing, wherein the housing defines a downhole kick-down profile.

In one embodiment a housing may define a limit structure, such as an annular shoulder, configured to limit axial shifting of the downhole component. The limit structure may permit the shifting tool to provide an over-pull force on the downhole component upon said component engaging said limit structure. Such ability to provide an over-pull may provide feedback that the component has been shifted to a desired location (for example to deactivate the component). Following such feedback the connecting member may be released form the downhole component. This may permit the shifting tool to be retrieved, or repositioned to shift a further downhole component.

The shifting tool may comprise a plurality of connecting members. The connecting members may be arranged circumferentially on the body. The connecting members may be configured to be actuated by a common, or separate, actuation arrangements.

The body may define a unitary structure. In such an arrangement the positioning arrangement and the connecting member may be provided on this unitary structure.

The body may comprise multiple body modules which are connected together, for example via one or more threaded connections. In one embodiment the positioning arrangement and the connecting member may be provided on a common body module. In an alternative embodiment the positioning arrangement may be provided on one body module and the connecting member may be provided on a different body module. Such an arrangement may permit a desired combination of specific connecting members and positioning arrangement to be utilised, for example to provide a shifting tool which is bespoke to a downhole component, The multiple body modules may be axially arranged relative to each other.

The shifting tool may be deployable downhole on an elongate member. For example, the shifting tool may be deployable on a tubing string, such as coiled tubing, production tubing, drill pipe or the like. The tubing string may facilitate fluid communication to the shifting tool, for example from surface. The shifting tool may be deployable on wireline. The body may be configured to be connected to an elongate member.

The downhole component may be provided in accordance with a collet as disclosed in WO 2011/117601 and/or WO 2011/117602, the disclosure of which is incorporated herein by reference. The downhole component may be provided in accordance with an indexing sleeve as disclosed in GB 1223191.6, the disclosure of which is incorporated herein by reference.

An aspect of the present invention relates to a downhole system, comprising:

a downhole component comprising a connection profile; and a shifting tool comprising:

a body;

a positioning arrangement provided on the body and configured to engage or interact with the downhole component to provide alignment of the shifting tool with said component; and a connecting member provided on the body and being moveable to selectively engage the connection profile of the downhole component.

The downhole system may comprise a housing, wherein the downhole component is mounted within and configured to be shifted through said housing.

An aspect of the present invention relates to a method for shifting a downhole component, comprising:

deploying a shifting tool towards the downhole component;

engaging the downhole component with a positioning arrangement of the shifting tool;

establishing a connection between the shifting tool and the downhole component with a connecting member; and shifting the downhole component with the shifting tool.

Further aspects of the present invention may relate to methods and apparatus for shifting a downhole component to deactivate said downhole component.

Further aspects of the present invention may relate to methods and apparatus for operating a downhole component or associated system with a shifting tool.

It should be understood that the features defined in relation to one aspect may be applied or provided in combination with any other aspect. For example, any defined methods of operation of a tool, apparatus or system disclosed herein may relate to operational steps with a method or process.

BRIEF DESCRIPTION OF DRAWINGS

These and other aspects of the present invention will now be described, by way of example only, with reference to the accompanying drawings, in which.

DETAILED DESCRIPTION OF DRAWINGS

Aspects of the present invention relate to a shifting tool which may be used to shift a downhole component. The shifting tool may be used to shift any number of different downhole components for any number of reasons. However, for exemplary purposes only, the following description relates to a specific downhole component which functions as an indexing sleeve operated by passage of one or more actuation balls, wherein a shifting tool according to one embodiment of the invention may be used to shift and reconfigure the indexing sleeve to a deactivated state.

Figure 1:
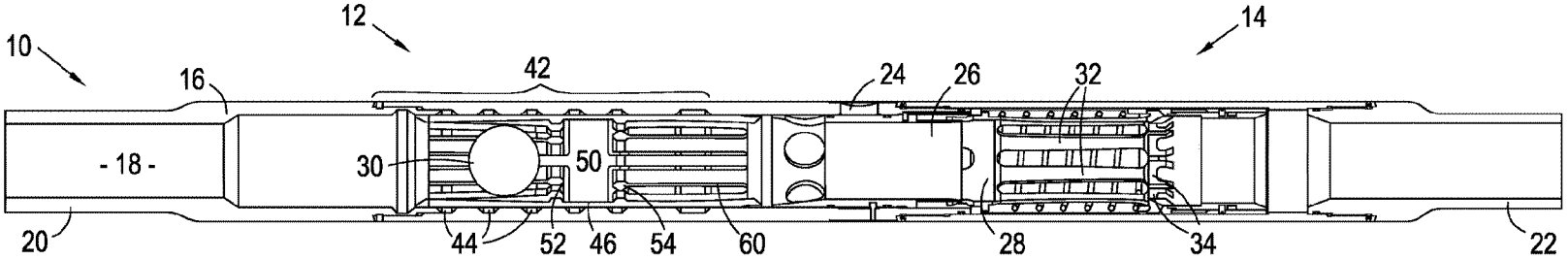
FIG. 1 a longitudinal sectional view of a downhole tool.

A cross sectional view of a downhole tool 10 is shown in FIG. 1. The tool 10 includes an actuator portion 12 and a tool portion 14 located on the downhole side of the actuator portion 12. In the example tool 10 shown, the actuator portion 12 and tool portion 14 are provided together to define the complete downhole tool 10. However, it should be recognised that the actuator and tool portions 12, 14 may be provided independently of each other. For example, the actuator portion 12 may be used to actuate any other downhole tool or system. Further, the tool portion 14 may be actuated by any other suitable actuator arrangement.

The downhole tool 10 comprises a housing 16 which defines a central bore 18 and extends between an uphole connector 20 and a downhole connector 22. The 20 connectors 20, 22 facilitate connection of the tool 10 within a tubular string (not shown), such as a work string, tool string, fracturing string or the like.

Fluid ports 24 (only one visible in FIG. 1) are provided radially through a wall of the housing 16 in the region of the tool portion 14, wherein the ports 24, when opened, facilitate outflow of a fluid from the central bore 18 of the housing 16 an into a surrounding formation. The tool portion 14 includes a valve member in the form of a sleeve 26 which is moveable axially along the housing 16 from a closed position in which the sleeve 26 blocks or closes the ports 24, as shown in FIG. 1, to an open position. Movement of the sleeve 26 towards its open position is achieved by the associated actuator portion 12, as described below.

The tool portion 14 further includes a catching sleeve 28 located downhole of the valve sleeve 26. The catching sleeve 28 is moveable from a free configuration, as shown in FIG. 1, in which a ball 30 may freely pass, to a catching configuration in which a ball 30 may be caught. More specifically, the catching sleeve 28 includes a number of radially moveable fingers 32 which each include a seat member 34 on the distal ends thereof. When in the free configuration, as shown in FIG. 1, the fingers 32 and seat members 34 are positioned radially outwardly and thus outside the path of travel of a ball 30. Upon actuation the catching sleeve 28 is moved axially to permit the fingers 32 and seat members 34 to move radially inwardly, and thus into the path of travel of a ball 30, thus permitting the ball 30 to be caught. In the present example, the catching sleeve 28 may function to catch a ball and establish diversion of any fluid from the central bore 18 outwardly through the fluid ports 24 when open. Further, in the present example the catching sleeve 28 is operated to move axially to its catching configuration by movement of the valve sleeve 26 towards its open configuration.

The actuator portion 12 defines an indexing profile 42 provided on the inner surface of the housing 16. The indexing profile 42 includes a plurality of axially spaced annular recesses 44 formed in the inner surface of the housing 16. A downhole component, in the form of an indexing sleeve 46 is mounted within the housing 16 and is configured to cooperate with the indexing profile 42 to be driven in a number of discrete linear movement steps through the housing 16 by passage of a corresponding number of actuation objects, specifically balls 30 in the present embodiment. The indexing sleeve 46 is driven in discrete movement steps until reaching an actuation site within the tool 10, where the indexing sleeve 46 engages and moves the valve sleeve 26 in a downhole direction to open the ports 24.

Figure 2:
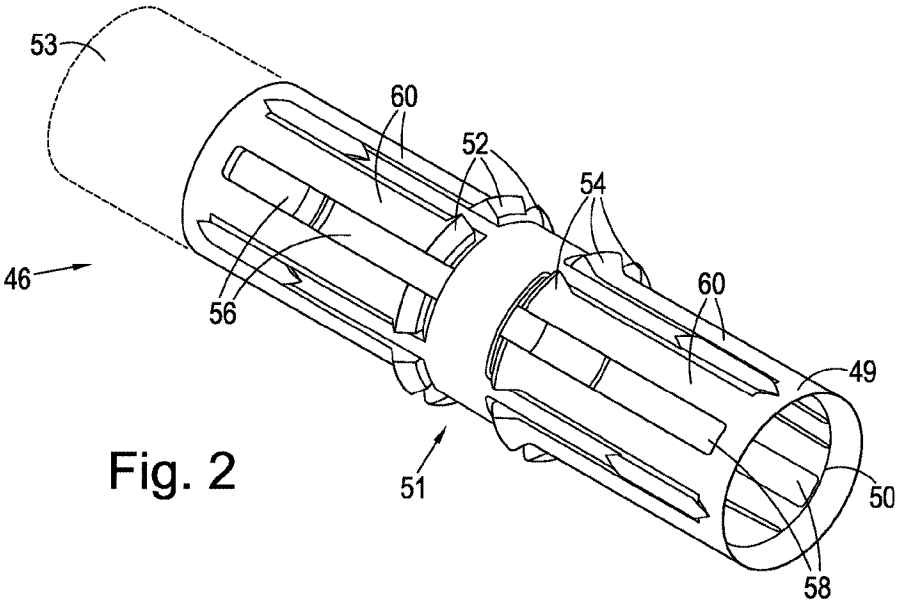
FIG. 2 a perspective view of a downhole component of the tool of FIG. 1, specifically an indexing sleeve of the tool.

A perspective view of the indexing sleeve 46 removed from the housing 34 is shown in FIG. 2, reference to which is additionally made.

The indexing sleeve 46 includes a tubular wall structure 49 which defines a central bore 50 corresponding with the central bore 18 of the housing 16. The central bore 50 is sized to permit an actuation object, specifically balls 30 to pass therethrough.

The indexing sleeve 46 also includes an interface arrangement 51 which includes first and second circumferential arrays of engagement members 52, 54 which are arranged such that the array of first engagement members 52 are axially spaced apart from the array of second engagement members 54. The engagement members are arranged within slots 56, 58 formed through the wall structure 49. As will be described in more detail below, the arrays of engagement members 52, 54 cooperate with the indexing profile 42 of the housing 16 to be sequentially engaged by a passing ball 30 to drive the indexing sleeve 46 one discrete linear movement step. More specifically, the first and second arrays of engagement members 52, 54 are arranged to be moved radially within their associated slots 56, 58 such that each array of engagement members 52, 54 is moved in an alternating or out of phase manner relative to the other array of engagement members 52, 54 by cooperation with the indexing profile 42 during movement of the indexing sleeve 46 through the housing 16. Such alternating radial movement alternately moves the first and second arrays of engagement members 52, 54 radially inwardly and into the central bore 50 of the indexing sleeve 46, to thus be sequentially engaged by a passing ball 30. In this way, a passing ball 30 may engage the engagement members 52, 54 of one of the first and second arrays to move the indexing sleeve 46 a portion of a discrete movement step, and then subsequently engage the engagement members 52, 54 of the other one of the first and second arrays to complete the discrete movement step of the indexing sleeve 46.

The engagement members 52, 54 are mounted on the distal end of respective collet fingers 60 which are secured at their proximal ends to the tubular wall structure 49. The collet fingers 60 are resiliently deformable to facilitate radial movement of the engagement members 52, 54 by cooperation with the indexing profile 42. In the present example the collet fingers 60 are unstressed when the engagement members 52, 54 are positioned radially outwardly and thus removed from the central bore 50. As such, the collet fingers 60 must be positively deformed by appropriate cooperation between the engagement members 52, 54 and the indexing profile 42 to move the engagement members 52, 54 radially inwardly into the central bore 50 to permit engagement by a ball 30. In such an arrangement, the collet fingers 60 may function to bias the engagement members 52, 54 in a direction to be moved radially outwardly from the central bore 50.

As will be described in more detail below, there may be circumstances where the indexing sleeve 46 must be shifted within the housing 16, without relying on passing balls 30. A shifting tool according to embodiments of the present invention may be used for this purpose. In this respect, to facilitate connection with a shifting tool the indexing sleeve 46 may further comprise a shifting portion 53, shown in broken outline in FIG. 2. The shifting portion 53 may include a connection profile on an inner surface thereof to facilitate connection with a shifting tool.

A sequential operation of the indexing sleeve 46 to move one discrete step by passage of a ball 30 will now be described in detail with reference to FIGS. 3A to 3E, which each illustrate a portion of the tool 10 in the region of the actuator portion 12.

In the illustrated sequence the ball 30 travels in the direction of arrow 70, and thus functions to move the indexing sleeve 46 in the same direction. The direction of travel of the ball 30 in the present example is in the downhole direction. However, the indexing sleeve 46 may also be moved by passage of a ball in an opposite, uphole direction. As such, generally, the direction of travel of the ball 30 may be considered as in a downstream direction.

Figure 3:
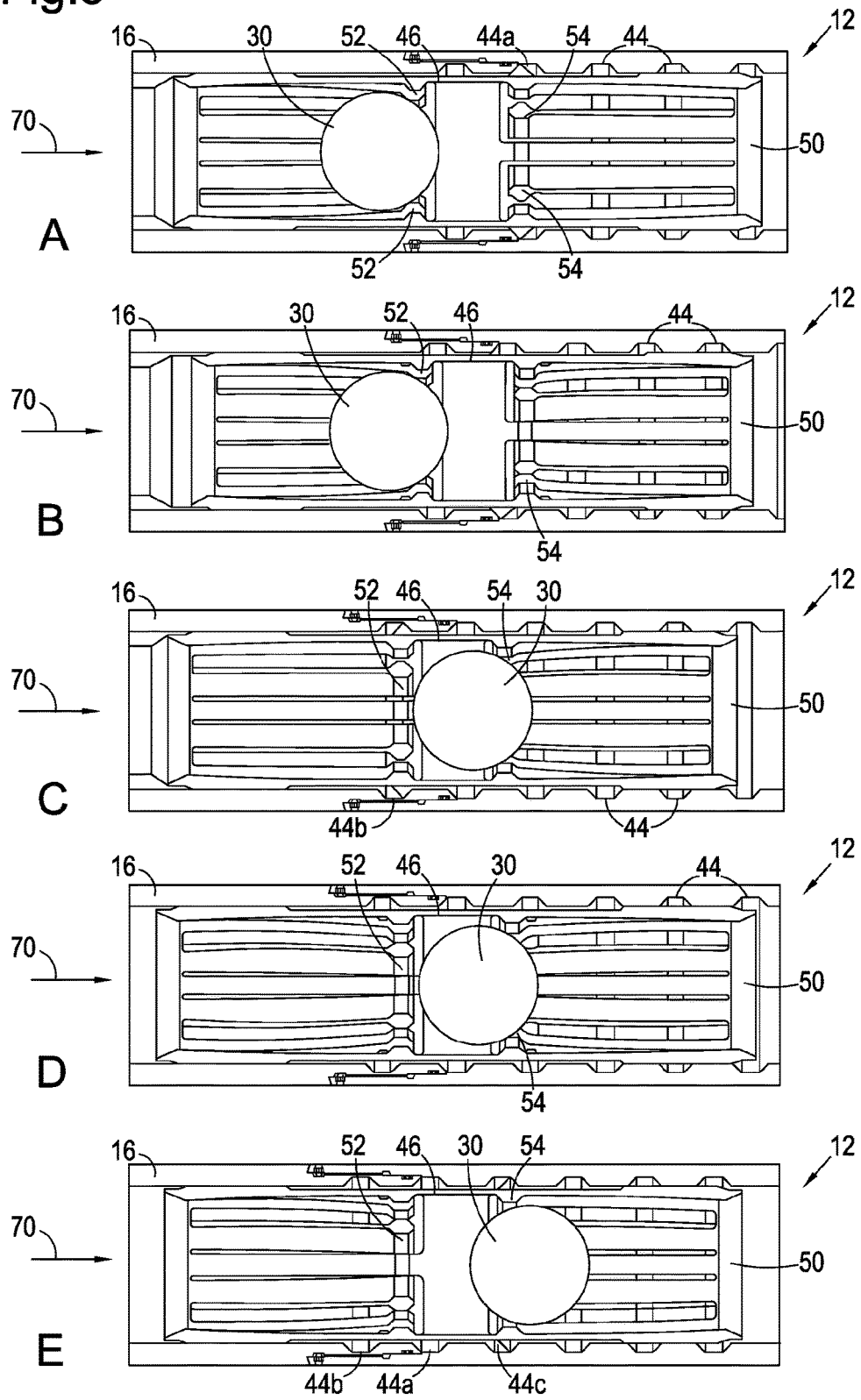
FIGS. 3A to 3E illustrate a sequence of normal operation of the downhole component of the tool of FIG. 1.

Prior to initiation of a discrete movement step, as shown in FIG. 3A, the indexing sleeve 46 is positioned within the housing 16 such that the engagement members 52 of the first array, which may be considered an upstream array, are positioned radially inwardly and thus presented into the central bore 50, whereas the engagement members 54 of the second array, which may be considered a downstream array, are positioned radially outwardly, and in fact received within an annular recess 44*a*. Such positioning of the engagement members 52, 54 is achieved by the relative axial spacing of the engagement members 52, 54 and the axial spacing, or pitch, of the annular recesses 44. That is, the axial spacing between the engagement members 52, 54 differs from, and specifically is larger than that of adjacent annular recesses 44. As such, when the engagement members 52, 54 of one of the first and second arrays are received within an annular recess 44 and outwardly positioned relative to the central bore 50, the engagement members 52, 54 of the other one of the first and second arrays will be positioned intermediate adjacent recesses 44 and thus positioned inwardly relative to the bore 50. Movement of the indexing sleeve 46 through the housing 16 therefore permits the radial position of the engagement members 52, 54 to be cyclically varied, permitting sequential engagement by a ball.

When the ball 30 reaches the indexing sleeve 46 the ball 30 will seat against the first or upstream array of engagement members 52, as shown in FIG. 3A, causing the indexing sleeve 46 to begin to move, as shown in FIG. 3B. Such movement will cause the first array of engagement members 52 to eventually become aligned with a recess 44*b*, and thus moved radially outwardly from the central bore 50, allowing the ball 30 to pass, as shown in FIG. 3C. However, at the same time the engagement members 54 of the second array will be deflected radially inwardly, to be positioned within the central bore 50, by misalignment with an annular recess 44. In this respect, in the embodiment shown the recesses 44 and the engagement members 52, 54 define corresponding ramped or tapered sides, for example of around 45 degrees, to facilitate or assist interaction during relative axial movement of the indexing sleeve 46 through the housing 16. As the engagement members 54 of the second array are now positioned radially inwardly the ball 30 will become seated against these engagement members 54, thus continuing to drive the indexing sleeve 46, as shown in FIG. 3D.

Eventually, the engagement members 54 of the second array will again become aligned with an annular recess 44*c*, thus permitting the ball 30 to be released and continue in the downstream direction, as shown in FIG. 3E. At the same time, the engagement members 52 of the first array will again be positioned intermediate adjacent annular recesses 44*a*, 44*b*, becoming radially inwardly deflected, and positioned to be engaged by a subsequent ball.

A number of the exemplary tools 10 of FIG. 1 may be used within a downhole system, such as a downhole fracturing system, arranged in series and configured to be actuated in a desired sequence. Such a desired sequence may be achieved by appropriate initial positioning of the indexing sleeve 46 in each tool 10, such that the tools 10 are operated in response to the passage of a different number of balls.

In some instances an operator may decide that the indexing sleeve 46 should no longer function to be actuated by passing balls, for example where an operator decides that actuation of an associated valve sleeve 26 to open ports 24 (FIG. 1) is no longer required. A shifting tool in accordance with an aspect of the present invention may be utilised to shift the indexing sleeve to a non-operational position, as will now be described below.

Figure 4:
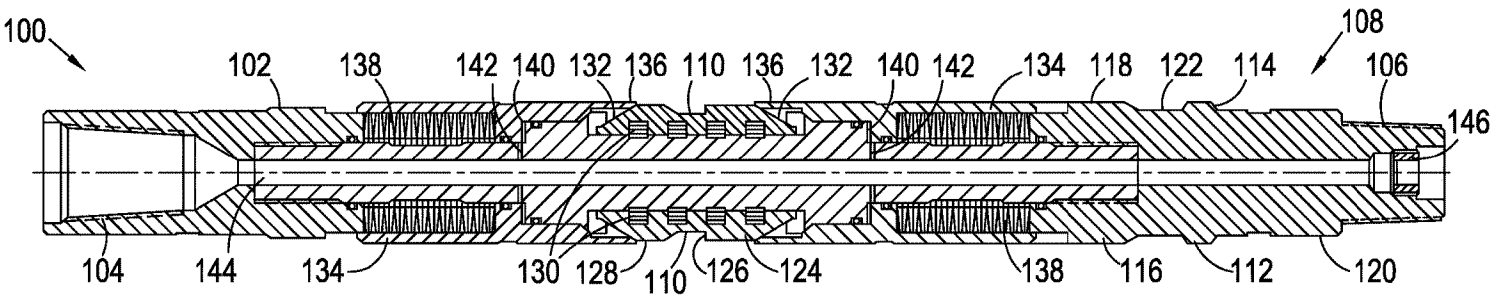
FIG. 4 a shifting tool, in accordance with embodiment of the present invention.

A cross-sectional view of a shifting tool, generally identified by reference numeral 100, in accordance with an exemplary embodiment of the present invention is illustrated in FIG. 4. The shifting tool 100 includes a body 102 which includes an uphole connector 104 and a downhole connector 106. Connectors 104, 106, which may be threaded connectors, may facilitate connection of the shifting tool 100 within a tool or work string.

The tool 100 further comprises a positioning arrangement 108 and a circumferential array of connecting members or dogs 110, wherein the positioning arrangement 108 and array of connecting members 110 are axially spaced apart on the body 102. As will be described in detail below, the positioning arrangement 108 provides alignment of the tool 100 with a downhole component, such as indexing sleeve 46 described above, specifically by interengagement with the interface arrangement 51 (FIG. 2) of the indexing sleeve 46. As will also be described in further detail below, the connecting members 110 facilitate connection with a downhole component, such as connection with the shifting portion 53 (FIG. 2) of the indexing sleeve 46.

The positioning arrangement 108 comprises a positioning profile which is defined by surface variations on the outer surface of the body 102. Specifically, the positioning profile includes a first or lower annular rib or lip 112 which defines and axially and downwardly facing engagement surface 114, arranged at a slight taper. The positioning profile further includes a second or upper annular rib or lip 116 which defines a radially facing circumferential surface 118. A first relief region 120 is positioned on one side of the first annular lip 112, and is defined by a region of reduced diameter relative to said lip 112. A second relief region 122 is axially interposed between the first and second annular lips 112, 116, and is defined by a region of reduced diameter relative to said lips 112, 116. In the embodiment shown the first and second lips 112, 114 define a substantially similar outer diameter, and in a similar fashion the first and second relief regions define a substantially similar outer diameter.

Each connecting member 110 includes a connecting portion 124 which includes an annular load shoulder 126, which is configured to cooperate with a corresponding load shoulder on an indexing sleeve to permit the shifting tool 100 to shift the indexing sleeve, as will described in more detail below.

Each connecting member 110 also includes a compliant portion 128 which may permit a degree of compliant interaction of the connecting members 110 with an indexing sleeve until appropriate alignment of the connecting portion 124 and load shoulder 126 is achieved to facilitate connection with the indexing sleeve.

Each connecting member 110 is mounted on the body 102 via a plurality of radially acting spring members 130 which function to bias the connection members 110 radially outwardly.

Each connecting member includes a ramp profile 132 on opposing axial sides thereof, wherein each ramp profile is configured to facilitate interaction with an actuation arrangement of the tool 100 for use in permitting the connecting members 110 to be selectively radially extended and retracted.

The actuation arrangement includes respective piston sleeves 134 concentrically mounted around the body 102 of the tool 100 on opposing axial sides of the connecting members 110. Each piston sleeve 134 includes an axial cylindrical extension 136 which extends to cooperate with a respective ramp profile 132 of the connecting members 110. The piston sleeves 134 are configured to stroke axially on the body 102, such that interaction between ramp profiles 132 on the connecting members 110 and the cylindrical extensions 136 of the piston sleeves 134 permits the connecting members 110 to be selectively moved radially. More specifically, each piston sleeve 134 may stroke axially away from the connecting members 110 such that said members may be radially extended by action of the springs 130, and stroked axially towards the connecting members 110 such that said members are forced radially inwardly against the bias of the springs 130.

Each piston sleeve 134 is biased via respective spring members 138 towards the connecting members 110, and thus towards a configuration in which the connecting members 110 are radially retracted.

Each piston sleeve 134 defines a hydraulic chamber 140 with the body 102 of the tool 100, and respective ports 142 provide fluid communication between a central bore 144 of the tool 100 and each chamber 140. Accordingly, an increase in fluid pressure within the central bore 144 of the tool 100 may permit each piston sleeve 134 to stroke axially, against the bias of the respective springs 138, and thus permit the connecting members 110 to be radially extended. In the embodiment shown the tool 100 comprises a nozzle 146 at a lower end thereof, wherein the nozzle defines a fluid restriction, such as an orifice. In use, the nozzle 146 will establish a back pressure in a fluid flowing through the central bore 144. Accordingly, varying the flow rate of a fluid through the tool 100 may permit the back pressure to be varied, and thus control operation of the piston sleeves 134.

The shifting tool 100 may be suitable for use in shifting a number of different kinds of downhole component. However, an exemplary use of the shifting tool 100 will now be described with reference to FIGS. 5A to 5C, in which the indexing sleeve 46 of the tool 10 of FIG. 1 is shifted.

As noted above, in some instances an operator may decide that the indexing sleeve 46 of the example tool 10 should no longer function to be actuated by passing balls, for example where an operator decides that actuation of an associated valve sleeve 26 to open ports 24 (FIG. 1) is no longer required. In the following example the shifting tool 100 of FIG. 4 is used to shift the indexing sleeve 46 to a non-operational position.

Figure 5A:
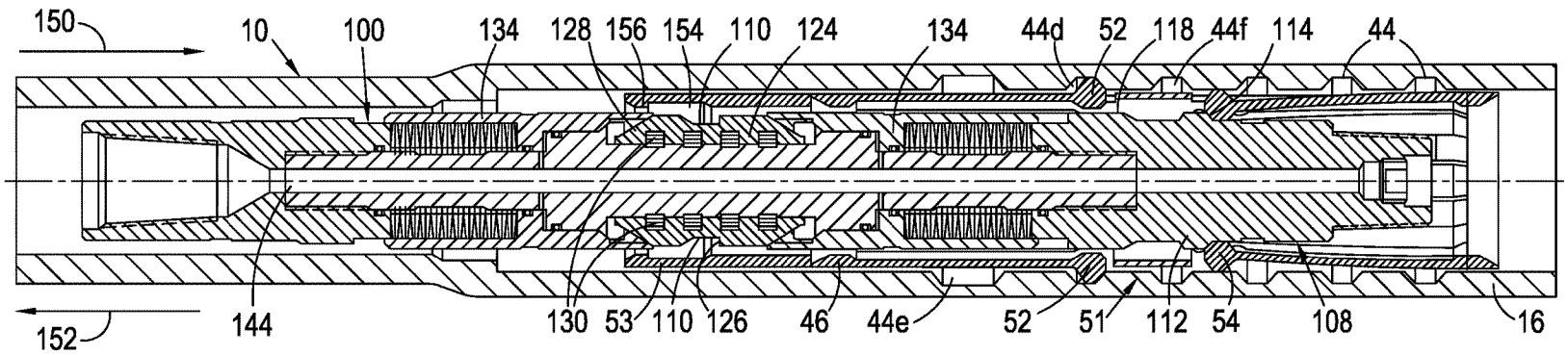
FIGS. 5A to 5C illustrate a sequential operation of the use of the shifting tool of FIG. 3 in shifting the downhole component of the tool of FIG. 1.

Referring initially to FIG. 5A, the shifting tool 100 is shown initially deployed into the tool 10 in a deployment direction 150. In the present example the intention is to use the shifting tool 100 to shift the indexing sleeve 46 in an opposite shifting direction 152. The tool may 100 may deployed on a suitable elongate member or structure (not show), such as coiled tubing.

The shifting tool 100 is deployed until the axial engagement surface 114 of the lower lip 112 engages the lower array of engagement members 54, which members 54 are positioned radially inwardly due to being located intermediate adjacent annular recesses 44 of the housing 16 of the tool 10. When the shifting tool 100 is in this position, the radially facing circumferential surface 118 of the upper lip 116 is axially aligned with the upper array of engagement members 52, which members 52 are positioned radially outwardly and received within annular recess 44*d*. Accordingly, the radially facing surface 118 prevents the upper engagement members 52 from being released from the recess 44*d*, thus effectively causing the indexing sleeve 46 to be axially locked within the housing 16, particularly locked against movement in the deployment direction 150. Accordingly, further movement of the shifting tool 100 in the deployment direction 150 is not permitted, which may provide some feedback, for example to an operator, that the shifting tool 100 has been appropriately positioned relative to the indexing sleeve.

As described above, to facilitate a suitable connection with the shifting tool 100 the indexing sleeve 46 includes a shifting portion 53. In the embodiment shown the shifting portion 53 includes an annular recess 154 formed in the inner surface thereof, wherein the annular recess 154 defines an annular load shoulder 156 which is formed to cooperate with the respective load shoulders 126 of the connecting members 110. When the shifting tool 100 is in this initial engaged position of FIG. 5A, the respective connecting portions 124 of the connecting members 110 are not axially aligned with the annular recess 154 of the indexing sleeve 46. Such misalignment is achieved by appropriate relative axial spacing between the connecting members 110 and the positioning arrangement 108 of the shifting tool 100, and between the annular recess 154 and the interface arrangement 51 of the indexing sleeve 46. The relative axial spacing is such that a degree of initial overshoot of the connecting members 110 in the deployment direction 150 is permitted, thus requiring some initial movement of the shifting tool 100 in the shifting direction 152 to achieve alignment of the respective connecting portions 124 and the annular recess 154. As will become apparent from the description below, this initial overshoot permits the shifting tool 100 to initially lock the indexing sleeve 46 within the housing to provide feedback that the shifting tool 100 has been appropriately positioned within the indexing sleeve 46, and then subsequently be moved in the shifting direction to both provide alignment between the connecting members 110 and the annular recess 154, and permit the indexing sleeve 46 to be unlocked, and thus permitted to be shifted through the housing 16 in the shifting direction 152.

Figure 5B:
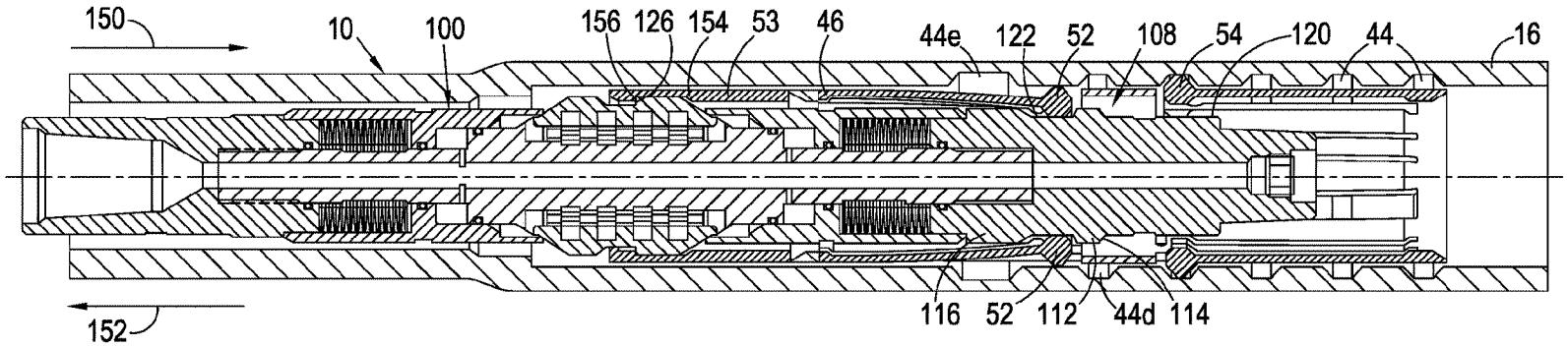

Once the shifting tool 100 is appropriately positioned as shown in FIG. 5A, the piston sleeves 134 may be actuated by increasing the backpressure of fluid flow within the central bore 144 of the tool 100, thus permitting the connecting members 110 to be radially extended by action of the springs 130. Due to the initial overshoot of the connecting members 110 in the deployment direction 150, such radial extension of said members 110 will not yet provide full connection and engagement between the respective load profiles 126, 156 of the connecting portions 124 and the annular recess 154. In this respect, following extension of the connecting members 110, the shifting tool 100 is moved in the shifting direction 152, with the compliant portions 128 of the respective connecting members 110 allowing said members 110 to comply (by varying the radial position of the members 110 due to contact with the indexing sleeve 46) with the profile of the annular recess 154, until the respective connecting portions 124 of the connecting members 110 are received within the annular recess 154 and establish engagement of the respective load shoulders 126, 156, as shown in FIG. 5B.

Due to this initial movement of the shifting tool 100 in the shifting direction 152 to facilitate connection between the connection members 110 and the recess 154, the positioning arrangement 108 of the tool 100 has become realigned with the interface arrangement 51 of the indexing sleeve 46, such that said sleeve 46 is no longer locked relative to the housing 16. That is, in the configuration of FIG. 5B, the lower array of engagement members 54 are axially aligned with the lower relief portion 120 of the positioning arrangement 108, and the upper array of engagement members 52 are axially aligned with the upper relief portion 122. Such alignment may thus permit the engagement members 52, 54 to be freely radially displaced inwardly upon interaction with the annular recesses 44 as the indexing sleeve 46 is shifted or pulled in the shifting direction through the housing 16 by the shifting tool 100.

Figure 5C:
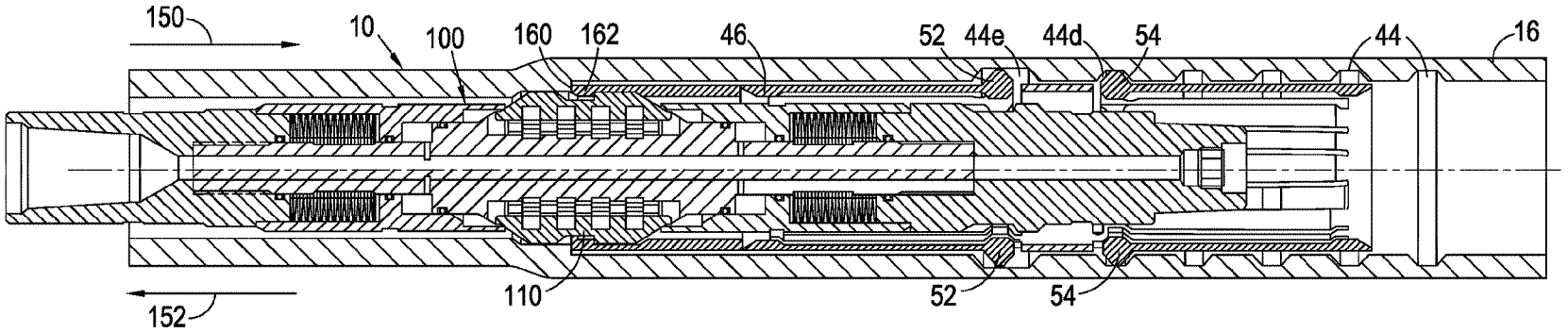

The indexing sleeve 46 may be shifted in the shifting direction 152 until the upper array of engagement members 52 become aligned and received within an uppermost annular recess 44*e*, and the lower array of engagement members 54 become aligned and received within an adjacent annular recess 44*d*, as shown in FIG. 5C. In this respect, the uppermost recess 44*e* and the adjacent recess 44*d* are arranged at the same axial spacing as the upper and lower arrays of engagement members 52, 54, such that all engagement members 52, 54 may be radially extended into these recesses 44*d*, 44*e* simultaneously. When in this position, the indexing sleeve 46 may be considered to be deactivated, in that any subsequent passage of a ball will not interact with the engagement members 52, 54 to move the indexing sleeve.

In the example illustrated, the housing 16 of the downhole tool 10 includes an annular shoulder 160 which is engaged by the upper end 162 of the indexing sleeve 46 when the engagement members 52, 54 become aligned with the respective recesses 44*e*, 44*d*, as shown in FIG. 5C. Such engagement may permit a degree of overpull to be achieved, which may provide feedback to an operator that the indexing sleeve 46 has been located in its deactivated position. In an alternative embodiment, the housing 16 may define a kick-down profile, such as a ramp surface, which engages the connecting members 110 when the indexing sleeve 46 has been sufficiently shifted, to cause said members 110 to be forced radially inwardly and thus release the connection with the indexing sleeve 46. Such disconnection may provide feedback to an operator, that the indexing sleeve 46 has been appropriately shifted.

In the sequential operation described above it has been assumed that the indexing sleeve 46 is initially presented with the upper array of engagement members 52 received within a recess 44*d*, with the lower array of engagement members 54 positioned intermediate adjacent recesses 44 and thus radially retracted, as in FIG. 5A. However, this is not essential for the shifting tool to operate, and the shifting tool may provide initial shifting of the indexing sleeve 46 to adopt the position or configuration shown in FIG. 5A. For example, the indexing sleeve 46 may be initially arranged with the arrays of engagement members in their opposite positions to that shown in FIG. 5A, that is with the lower array of engagement members 54 received within a recess 44 and the upper array of engagement members 52 positioned intermediate adjacent recesses 44 and thus radially retracted. In such a case, the shifting tool 100 upon approaching the indexing sleeve in the deployment direction will initially engage the upper array of engagement members 52 via the lower annular lip 112, thus moving the indexing sleeve 46 initially in the deployment direction 150, until the upper engagement members 52 become received within a recess, thus presenting the indexing sleeve 46 in the configuration shown in FIG. 5A. Operation of the shifting tool 100 may then proceed in the same manner described above.

It should be understood that the embodiments described herein are merely exemplary and that various modifications may be made thereto without departing from the scope of the present invention.

For example, in the sequential operation described above the indexing sleeve 46 is initially positioned (as in FIG. 5A) only a single discrete movement step from its deactivated state. However, it should be understood that the shifting tool 100 may operate in combination with the indexing sleeve 46 when positioned any number of discrete movement steps from its deactivated state.

Further, the shifting tool may be used to shift any downhole component for any reason. For example, the shifting tool may shift a downhole component to be arranged in an activated state (as opposed to the deactivated state as in the example provided). Further, the shifting tool may function to operate a downhole component, for example to shift a valve sleeve to open, close or vary one or more flow ports.

The invention claimed is:

1. A downhole shifting tool for shifting a downhole component, comprising:

a body;

a positioning arrangement comprising at least one body profile provided on the body for engaging or interacting with an interface arrangement of a downhole component to provide alignment of the shifting tool with said downhole component, wherein the interface arrangement comprises first and second axially spaced engagement members arranged to be cyclically moved radially out of phase relative to each other by cooperation with a separate indexing profile provided on an outer housing during movement of the downhole component through the housing; and a connecting member provided on the body and being moveable to selectively engage a connection profile of the downhole component, wherein once a connection is achieved between the connecting member and the connection profile, movement of the shifting tool will cause shifting of the downhole component.

2. The downhole shifting tool according to claim 1, wherein the positioning arrangement is configured to interact with an inner surface region or structure of the downhole component, and the connecting member is configured to engage a connection profile formed on an inner surface of the downhole component.

3. The downhole shifting tool according to claim 1, operable to at least one of rotate and axially shift the downhole component.

4. The downhole shifting tool according to claim 1, configured to prevent the downhole component from movement upon initial engagement of the positioning arrangement with the downhole component, at least until the connecting member makes or establishes an appropriate connection with the connection profile on the downhole component.

5. The downhole shifting tool according to claim 1, wherein, in use, the positioning arrangement engages the downhole component in a deployment direction and prevents the downhole component from movement in the deployment direction.

6. The downhole shifting tool according to claim 5, wherein the shifting tool locks the downhole component against movement in the deployment direction when initially engaged therewith.

7. The downhole shifting tool according to claim 1, wherein the positioning arrangement and the connecting member are axially spaced relative to each other such that, in use, when the positioning arrangement initially engages or interacts with the downhole component in a deployment direction the connecting member is misaligned with the connection profile on the downhole component.

8. The downhole shifting tool according to claim 7, wherein the misalignment between the connecting member and the connection profile is provided in the deployment direction, such that the connecting member is permitted to initially travel past the connection profile in the deployment direction.

9. The downhole shifting tool according to claim 8, wherein the shifting tool, in use, is arranged to be subsequently moved in an opposite shifting direction to align and permit engagement of the connecting member with the connection profile, wherein when such alignment is achieved the positioning arrangement is disengaged from the downhole component, and positioned such that the downhole component is no longer locked, and is free to be shifted by the shifting tool.

10. The downhole shifting tool according to claim 7, wherein the connecting member may be moveable towards a connected position prior to alignment with the connection profile of the downhole component, such that upon achieving alignment a suitable connection may be achieved.

11. The downhole shifting tool according to claim 1, wherein the at least one body profile of the positioning arrangement defines a positioning profile configured to interact with the downhole component.

12. The downhole shifting tool according to claim 11, wherein the positioning profile is formed on an outer surface of the body of the shifting tool.

13. The downhole shifting tool according to claim 11, wherein the positioning profile is formed to facilitate engagement with the downhole component in an axial direction.

14. The downhole shifting tool according to claim 11, wherein the positioning profile facilitates engagement with the downhole component in a radial direction.

15. The downhole shifting tool according to claim 14, wherein the engagement in the radial direction permits the shifting tool to lock the downhole component against movement.

16. The downhole shifting tool according to claim 1, wherein the interface arrangement of the downhole component is separate from the connection profile, such that the positioning arrangement and the connecting member of the shifting tool are arranged to engage separate features or regions of the downhole component.

17. The downhole shifting tool according to claim 1, wherein the interface arrangement and connection profile of the downhole component are separated by a first axial distance, and the connecting member and positioning arrangement are separated by a second axial distance.

18. The downhole shifting tool according to claim 17, wherein the first and second distances are different.

19. The downhole shifting tool according to claim 1, wherein cooperation and engagement between the positioning arrangement of the shifting tool, the interface arrangement of the downhole component and the separate indexing profile facilitates locking of the downhole component within the housing.

20. The downhole shifting tool according to claim 1, wherein the shifting tool is configured to shift the downhole component to align the interface arrangement with a deactivated region of an associated indexing profile to permit the interface arrangement to adopt a deactivated configuration.

21. The downhole shifting tool according to claim 1, wherein the interface arrangement includes at least one engagement member which is radially moveable between a radially outward position and a radially inward position.

22. The downhole shifting tool according to claim 21, wherein the positioning arrangement is configured to axially engage at least one engagement member when said at least one engagement member is positioned radially inwardly to facilitate appropriate alignment between the shifting tool and the at least one engagement component.

23. The downhole shifting tool according to claim 21, wherein the positioning arrangement is configured to radially support at least one engagement member when said at least one engagement member is positioned radially outwardly to facilitate locking of the downhole component.

24. The downhole shifting tool according to claim 21, wherein the at least one body profile of the positioning arrangement comprises a positioning profile which includes an axially facing surface profile for axially engaging at least one engagement member when said at least one engagement member is positioned radially inwardly.

25. The downhole shifting tool according to claim 24, wherein the axially facing surface profile is provided on an annular lip provided or formed on the body.

26. The downhole shifting tool according to claim 21, wherein the at least one body profile of the positioning arrangement comprises a positioning profile which includes a radially facing surface profile for radially interacting with at least one engagement member when aligned therewith and preventing radial inward movement of said at least one engagement member.

27. The downhole shifting tool according to claim 26, wherein the radially facing surface profile is provided on an annular lip provided or formed on the body.

28. The downhole shifting tool according to claim 21, wherein the at least one body profile of the positioning arrangement includes a relief profile for permitting radial movement of at least one engagement member when aligned therewith.

29. The downhole shifting tool according to claim 28, wherein the relief profile is axially spaced from the connecting member such that when the connecting member is engaged with a connection profile on the downhole component, the relief profile is axially aligned with an engagement member.

30. The downhole shifting tool according to claim 1, wherein the shifting tool is configured to shift the downhole component such that the interface arrangement is deactivated.

31. The downhole shifting tool according to claim 1, wherein the positioning arrangement is positioned on a downhole side of the connecting member.

32. The downhole shifting tool according to claim 1, wherein the connecting member defines a releasable connecting member configured to provide a releasable connection with the connection profile of the downhole component.

33. The downhole shifting tool according to claim 1, wherein the connecting member is radially moveable relative to the body to selectively engage a connection profile of the downhole component.

34. The downhole shifting tool according to claim 1, comprising an actuation arrangement for actuating the connecting member to selectively engage the connection profile of the downhole component.

35. The downhole shifting tool according to claim 34, wherein the actuation arrangement comprises a piston assembly.

36. The downhole shifting tool according to claim 35, wherein the piston assembly positively moves the connecting member in at least one radial direction.

37. The downhole shifting tool according to claim 35, wherein the connecting member is biased in a radial direction and the piston assembly is operable to act against a bias force associated with the connecting member.

38. The downhole shifting tool according to claim 37, wherein the connecting member is biased radially outwardly, and the piston assembly is operable to move the connecting member radially inwardly.

39. The downhole shifting tool according to claim 35, wherein the piston assembly is engaged with the connecting member via an actuation interface which converts axial stroking motion of the piston assembly to radial motion of the connecting assembly.

40. The downhole shifting tool according to claim 35, wherein the piston assembly is fluid actuated or operated.

41. The downhole shifting tool according to claim 35, wherein the body defines a central bore for receiving an actuation fluid and communicating this fluid to the piston assembly.

42. The downhole shifting tool according to claim 35, wherein the piston assembly comprises a piston member configured to stroke axially relative to the body and permit actuation of the connecting member.

43. The downhole shifting tool according to claim 1, wherein the connecting member comprises a no-go profile for providing an axial connection between the shifting tool and the downhole component in at least one direction.

44. The downhole shifting tool according to claim 1, wherein the connecting member comprises a kick-down profile configured to engage a corresponding downhole kick-down profile to permit the connecting member to disengage the connection profile of the downhole component.

45. A method for shifting a downhole component, comprising:

deploying a shifting tool towards the downhole component;

engaging a positioning arrangement of the shifting tool with an interface arrangement of the downhole component, the positioning arrangement comprising at least one body profile, wherein the interface arrangement comprises first and second axially spaced engagement members arranged to be cyclically moved radially out of phase relative to each other by cooperation with a separate indexing profile provided on an outer housing during movement of the downhole component through the housing;

establishing a connection between the shifting tool and the downhole component with a connecting member; and shifting the downhole component with the shifting tool.

46. A downhole shifting tool for shifting a downhole component, comprising:

a body;

a positioning arrangement comprising at least one body profile provided on the body for engaging or interacting with an interface arrangement of a downhole component to provide alignment of the shifting tool with said component, wherein the interface arrangement of the component is configured to cooperate with an indexing profile on a housing within which the component is mounted, wherein cooperation and engagement between the positioning arrangement of the shifting tool, the interface arrangement of the component and the separate indexing profile facilitates alignment of the shifting tool and the component; and a connecting member provided on the body and being moveable to selectively engage a connection profile of the downhole component wherein the component to be shifted defines an interface arrangement, wherein the positioning arrangement is engageable with said interface arrangement.

47. The downhole shifting tool according to claim 46, wherein the positioning arrangement is configured to initially engage the interface arrangement in a deployment direction, such that one engagement member which is positioned radially inwardly is axially engaged in this deployment direction, and the other engagement member which is positioned radially outwardly is prevented from becoming radially retracted.

48. The downhole shifting tool according to claim 46, wherein the at least one body profile of the positioning arrangement comprises a positioning profile which includes an axially facing surface profile and a radially facing surface profile axially separated along the body at an axial separation which permits the axially facing surface profile to axially engage one of the first and second engagement members when said one engagement member is positioned radially inwardly, and the radially facing surface profile to simultaneously be axially aligned with the other of the first and second engagement members when said other engagement member is positioned radially outwardly.

49. The downhole shifting tool according to claim 48, wherein the positioning profile defines first and second relief profiles axially separated along the body at an axial separation which permits both relief profiles to be simultaneously axially aligned with a respective engagement member and allow radial movement of both of the first and second engagement members.

50. The downhole shifting tool according to claim 49, wherein the relief profiles are axially spaced from the connecting member such that when the connecting member is engaged with a connection profile on the downhole component, the relief profiles are axially aligned with a respective one of the first and second engagement members.

51. The downhole shifting tool according to claim 49, wherein the first relief profile is positioned on one axial side of both the axially and radially facing surface profiles, and a second relief profile is positioned axially intermediate the axially and radially facing surface profiles.

* * * * *